US007364536B2

(12) United States Patent
Cappellini et al.

(10) Patent No.: US 7,364,536 B2
(45) Date of Patent: Apr. 29, 2008

(54) WEIGHT BAR WITH INTERNALLY-THREADED AXIAL ENDS

(75) Inventors: Cesar A. Cappellini, Newport Beach, CA (US); Vu T. Dang, Santa Ana, CA (US)

(73) Assignee: Bell Foundry Company, South Gate, CA (US)

( * ) Notice: Subject to any disclaimer, the term of this patent is extended or adjusted under 35 U.S.C. 154(b) by 59 days.

(21) Appl. No.: 10/987,050

(22) Filed: Nov. 12, 2004

(65) Prior Publication Data

US 2006/0105891 A1 May 18, 2006

(51) Int. Cl.
*A63B 21/072* (2006.01)

(52) U.S. Cl. ..... 482/106; 482/107; 482/108

(58) Field of Classification Search ..... 482/106–109; D21/680–682

See application file for complete search history.

(56) References Cited

U.S. PATENT DOCUMENTS

| | | | | |
|---|---|---|---|---|
| 2,470,815 | A | 5/1949 | Harvey | |
| 3,726,522 | A | 4/1973 | Silberman | |
| 3,913,908 | A | 10/1975 | Speyer | |
| 4,029,312 | A | 6/1977 | Wright | |
| 4,076,236 | A | 2/1978 | Ionel | |
| 4,722,523 | A * | 2/1988 | Yang | 482/108 |
| 5,033,740 | A * | 7/1991 | Schwartz et al. | 482/105 |
| 5,142,464 | A * | 8/1992 | Wang | 362/295 |
| 5,328,431 | A * | 7/1994 | Winslow | 482/106 |
| 5,399,135 | A | 3/1995 | Azzouni | |
| 5,496,243 | A | 3/1996 | Allen | |
| 5,607,379 | A | 3/1997 | Scott | |
| 5,931,511 | A * | 8/1999 | DeLange et al. | 285/334 |
| 6,592,499 | B2 | 7/2003 | Parker | |
| 6,599,222 | B2 * | 7/2003 | Wince | 482/106 |
| 6,939,276 | B2 * | 9/2005 | Gates | 482/111 |

FOREIGN PATENT DOCUMENTS

| | | |
|---|---|---|
| DE | 43 28 251 A1 | 9/1994 |
| FR | 2 735 986 | 1/1997 |
| SU | 1674868 A1 | 9/1991 |
| SU | 1766430 A1 | 10/1992 |
| WO | WO 93/09850 | 5/1995 |

OTHER PUBLICATIONS

Shigley, Joseph E. and Charles R. Mischke. Mechanical Engineering Design, Sixth Edition. New York: McGraw-Hill, 2001. 446-450.*

* cited by examiner

*Primary Examiner*—Fenn C. Mathew
*Assistant Examiner*—Allana Lewin
(74) *Attorney, Agent, or Firm*—Christie, Parker & Hale, LLP.

(57) ABSTRACT

A weight bar for use with a dumbbell having an externally-threaded end is provided that includes a substantially cylindrical elongated bar having a longitudinal axis, first and second axial ends and an intermediate section extending between the axial ends. The first and second axial ends each comprise internally-threaded sections disposed substantially along the longitudinal axis of the weight bar for threadably receiving an externally-threaded end of a dumbbell. The internally-threaded sections of the first and second axial ends each comprise threads having substantially flat thread ends.

26 Claims, 5 Drawing Sheets

WEIGHT BAR WITH INTERNALLY-THREADED AXIAL ENDS

FIELD OF THE INVENTION

The present invention relates in general to a weight bar used for fitness exercises, and in particular to a weight bar with ends having internal threads for use with dumbbells having externally-threaded ends.

BACKGROUND

The need for proper fitness has long been recognized to help maintain a long and healthy life. Many people have purchased dumbbells to aid in their fitness training. Dumbbells are typically held in one hand during performance of a fitness exercise. A common dumbbell includes a central portion, to be grasped a user's hand, and axial ends for receiving weight plates. A shoulder separates the central portion from each of its axial ends and provides a stop for receiving the weight plates.

Commonly, the axial ends of the dumbbell are externally-threaded for forming a threaded connection with the internal threads of a threaded collar. As such, when one or more weight plates are disposed on the axial ends of the dumbbell, the weight plates can be held between the shoulder and the collar by the threaded engagement of the collar to the threaded axial end. A convenience of the above described dumbbell is that different numbers and/or weights of weight plates can be attached to the dumbbell so that the weight of the dumbbell can be changed to different desired weights without the need for purchases multiple dumbbells.

A deficiency of common dumbbells, however, is that they are short and designed for manipulation by a single hand. Thus many exercises, which require and/or are facilitated by an elongated bar which may be grasped by two hands that are approximately a shoulder width apart, cannot be performed by typical dumbbells. Thus, a user is often required to purchase or obtain another weight system that includes an elongated bar. Having to purchase another exercise system with matching weights can be cumbersome and expensive.

Weight bars have been proposed with brackets at their axial ends to attach dumbbells, but these designs are cumbersome and do not utilize the existing externally-threaded ends of typical dumbbells. Some proposed designs have weight bars with threaded ends, but the thread designs on these bars is such that the bar can only be used with a specifically matched set of dumbbells having a specifically matched thread design. Thus, a user must purchase both a new weight bar and a matching set of dumbbells and cannot use dumbbells that they may already own.

In addition, threaded dumbbells often include flat box-shaped thread profiles allowing the load of the added weight plates to be distributed over a relatively large flat surface area, thus preventing undue thread wear and/or cutting into the weight plate. A weight bar having a standard thread profile, with sharp peaks or edges at their thread apex, cannot accept an externally-threaded dumbbell with a flat thread profile.

Accordingly, a need exists for a weight bar that can be used with externally-threaded dumbbells that have the flat thread profile. Furthermore, it may be desirable to have a weight bar that can accept a multitude of flat thread profiles, thus allowing the user of a wider range of existing dumbbells already on the market.

SUMMARY

In one embodiment, the present invention is a weight bar for use with a dumbbell having an externally-threaded end that includes a substantially cylindrical elongated bar having a longitudinal axis, first and second axial ends and an intermediate section extending between the axial ends. The first and second axial ends each include internally-threaded sections disposed substantially along the longitudinal axis of the weight bar for threadably receiving an externally-threaded end of a dumbbell. The internally-threaded sections of the first and second axial ends each include threads having substantially flat thread ends.

In another embodiment, the present invention is a weight bar for use with a dumbbell having an externally-threaded end that includes a substantially cylindrical elongated bar having a longitudinal axis, first and second axial ends, and an intermediate section extending between the axial ends. The first and second axial ends each include internally-threaded sections disposed substantially along the longitudinal axis for threadably receiving an externally-threaded end of a dumbbell, wherein the internally-threaded sections of the first and second axial ends each include box-shaped threads structured to receive varying sizes of external threads, and wherein the box-shaped threads include substantially flat thread ends.

In yet another embodiment, the present invention is a weight bar for use with a dumbbell having an externally-threaded end that includes a substantially cylindrical elongated bar having a longitudinal axis, first and second axial ends, and an intermediate section extending between the axial ends. The first and second axial ends each include internally-threaded sections disposed substantially along the longitudinal axis for threadably receiving an externally-threaded end of a dumbbell, wherein the internally-threaded sections of the first and second axial ends each include threads structured to receive varying sizes of external threads.

In still another embodiment, the present invention is an exercise system, including a substantially cylindrical elongated weight bar having a longitudinal axis, first and second axial ends, and an intermediate section extending between the axial ends. The first and second axial ends each include internally-threaded sections disposed substantially along the longitudinal axis, wherein the internally-threaded sections of the first and second axial ends each include threads having substantially flat thread ends. The exercise system also includes a first dumbbell having a first externally-threaded end that threadably engages the first axial end of the weight bar, and a second dumbbell having a first externally-threaded end that threadably engages the second axial end of the weight bar.

BRIEF DESCRIPTION OF THE DRAWINGS

These and other features and advantages of the present invention will be better understood by reference to the following detailed description of the embodiments when considered in conjunction with the accompanying drawings, in which like reference numbers represent corresponding parts throughout, wherein.

DETAILED DESCRIPTION OF EMBODIMENTS OF THE INVENTIONS

Figure 1:
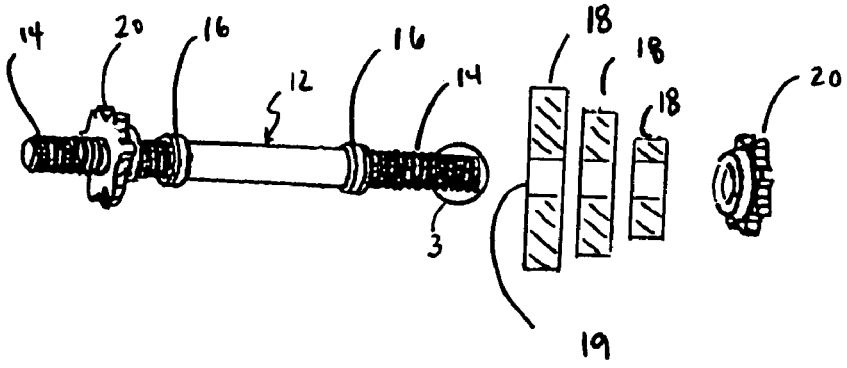
FIG. 1 is an exploded perspective view of a dumbbell system for use with a weight bar according to the present invention, with weight plates shown in cross-section.
Figure 2:
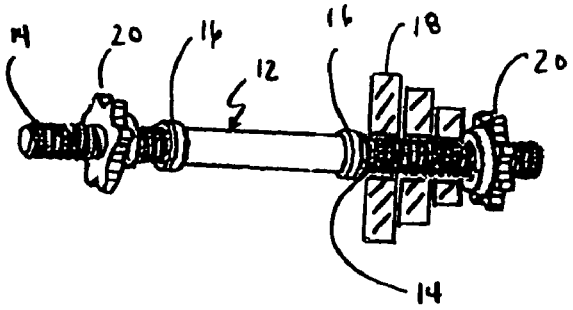
FIG. 2 is a perspective view of the dumbbell system of FIG. 1 in an assembled condition, again with the weight plates shown in cross-section.
Figure 3:
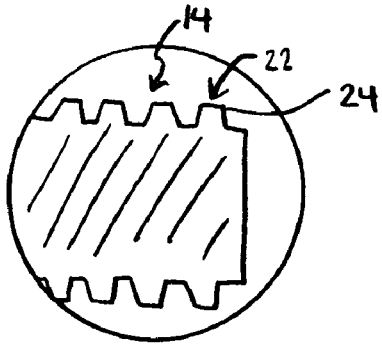
FIG. 3 is an enlarged view of an externally-threaded end of the dumbbell system of FIG. 1.

As shown in FIGS. 1-9, embodiments of the present invention are directed to a weight bar 10 having internally-threaded ends 30 each for receiving an externally-threaded end 14 of a dumbbell 12. FIGS. 1-3 show one embodiment of a dumbbell 12 for use with the weight bar 10 of the present invention. The dumbbell 12 includes externally-threaded end sections 14. Adjacent to each threaded end section 14 is an integral enlarged diameter forming a shoulder 16. Weight plates 18 (shown in cross-section) having central openings 19 are interchangeably and removeably disposed on the dumbbell 12 by sliding the plates 18 over the threaded end sections 14 of the dumbbell 12. An internally-threaded collar 20 is threadably engaged with the threaded end section 14 of the dumbbell 12 to secure the weight plates 18 between the dumbbell shoulder 16 and the internally-threaded collar 20 as shown in FIG. 2.

Although the weight plates 18 are shown in FIG. 2 on only one of the threaded end sections 14 of the dumbbell 12, similar weight plates can be secured to each threaded end section 14 of the dumbbell 12. In addition, any desired number of weight plates 18 having any desired total weight many be interchangeably and removably added to the end sections 14 of the dumbbell 12 to vary the weight of the dumbbell 12.

FIG. 3 shows an exemplary thread detail of the threaded end sections 14 of the dumbbell 12. In this embodiment, the threaded end sections 14 of the dumbbell 12 have threads 22 with flat thread ends 24. As used herein, the flat thread ends 24 of the dumbbell threads 22 is meant to refer to that portion of the threads 22 which supports the weight of the weight plates 18. Threads having flat thread ends are sometimes referred to as "box-shaped" threads or "acme" threads.

Figure 4:
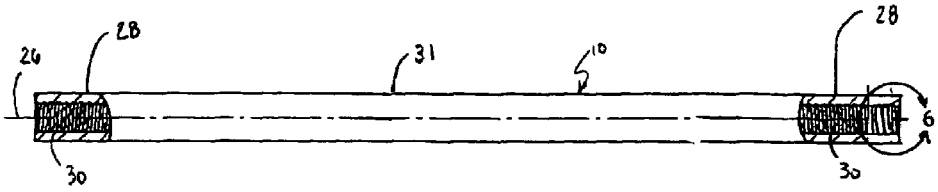
FIG. 4 is a side view of a weight bar according to one embodiment of the present invention, with cut away sections showing internally-threaded axial ends of the weight bar.
Figure 5:
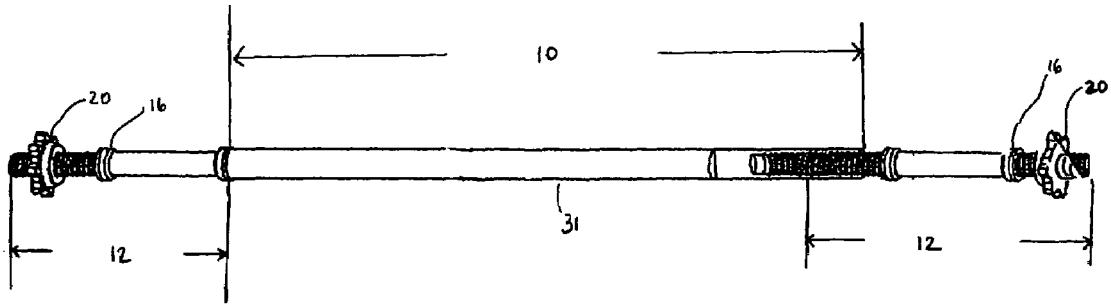
FIG. 5 is a perspective view of the weight bar of FIG. 4 having the dumbbell of FIG. 1 attached to each of its axial ends, and having a cut away section showing the threading engagement of an external end of one of the dumbbells with an internal section of one of the axial ends.
Figure 6:
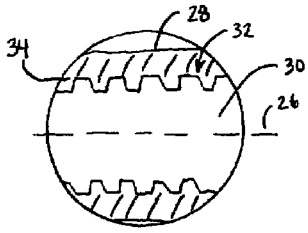
FIG. 6 is an enlarged view of an internally-threaded end of the weight bar of FIG. 4.

FIGS. 4-6 show an exemplary embodiment of a weight bar 10 according to the present invention. In this embodiment, the weight bar 10 is a substantially cylindrical elongated bar having a longitudinal axis 26, first and second axial ends 28, and an intermediate section 31 extending between the axial ends 28. In one embodiment, the axial ends 28 are substantially similar and are thus described jointly below in order to avoid duplicity.

The first and second axial ends 28 each have internally-threaded sections 30 disposed substantially along the longitudinal axis 26 of the weight bar 10 for threadably receiving one of the externally-threaded end sections 14 of a dumbbell 12 (as described above.) Similar to the threads 22 on the end sections 14 of the dumbbell 12, the internally-threaded sections 30 of the axial ends 28 of the weight bar 10 have threads 32 with substantially flat thread ends 34. AS mentioned above, threads having flat thread ends are sometimes referred to as "box-shaped" threads or "acme" threads. As shown in FIG. 6, the flat thread ends 34 of the weight bar threads 32 extend substantially parallel to the longitudinal axis 26 of the weight bar 10.

When a dumbbell 12 is attached to each axial end 28 of the weight bar 10 (as shown for example in FIG. 5), weight plates 18 can be added to each dumbbell 12 and secured between the dumbbell shoulder 16 and the internally-threaded collar 20 of the dumbbell 12, as described, above; and the weight bar 10 may be used for conventional weight lifting exercises. As described above with respect to the dumbbell 12 itself, when dumbbells 12 are attached to the axial ends 28 of the weight bar 10, any desired number of weight plates 18 having any desired total weight many be interchangeably and removably added to the end sections 14 of the dumbbells 12 to vary the weight of the weight bar 10.

The box-shaped or flat thread end configuration 32 of the threads 32 of the weight bar 10 is advantageous since it allows the threads 22 on the dumbbells 12 to have correspondingly flat thread end 24. As shown in FIG. 2, the internal diameter of the weight plates 18 bear directly onto and are supported directly by the thread ends 24 of the dumbbell 12. Standard thread designs come to sharp peaks or edges at their thread apex or thread ends. These peaks are delicate and are not meant to carry a load unless engaged with a corresponding internal thread. When weight plates are slid upon a sharp thread apex, they can damage and destroy the thread. Flat thread ends, on the other hand, distribute weight from the weight plates over a larger surface area, thereby resisting damage to the threads. Weight plates 18 can therefore be supported directly on the flat thread ends 24 of the externally-threaded ends 14 of the dumbbells 12 when flat thread ends 34 are used in the internally-threaded sections 30 of the weight bar 10.

Figure 7:
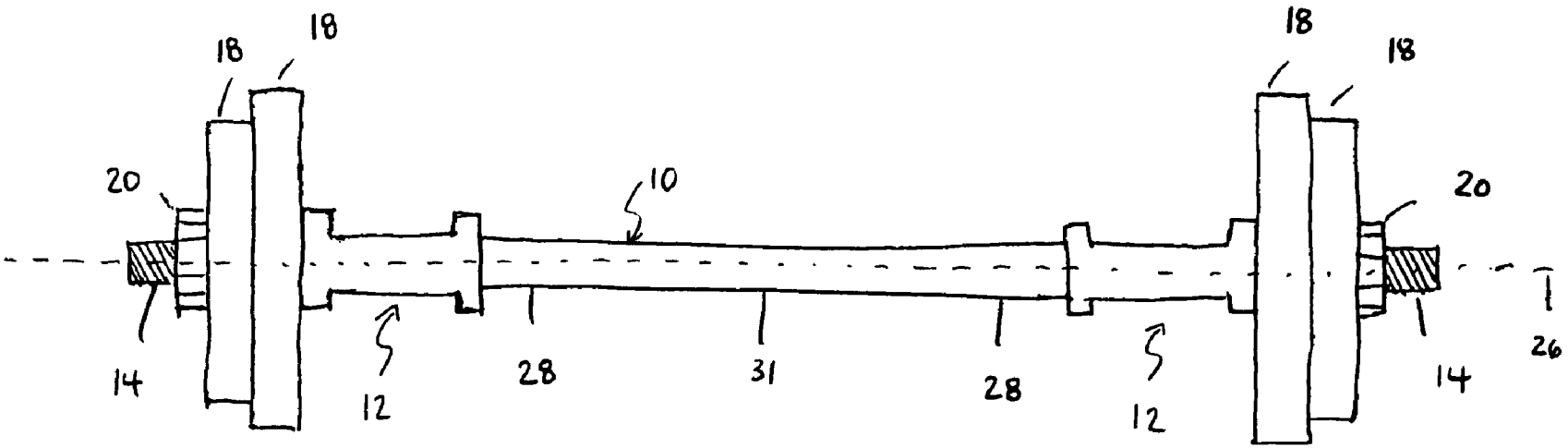
FIG. 7 is a side view of the weight bar and dumbbells or FIG. 5 showing weight plates attached to each dumbbell.

FIG. 7 illustrates one embodiment of the present invention with the dumbbells 12 attached to the axial ends 28 of the weight bar 10 and with weight plates 18 attached to each dumbbell 12. The dumbbells 12 are threadably attached to the weight bar 10 at the first and second axial ends 28 of the weight bar device 10. Each of the dumbbells 12 has two externally-threaded ends 14. One externally-threaded end 14 of each dumbbell 12 is threadably attached to the internally-threaded section 30 of one of the axial ends 28 of the weight bar 10. The other externally-threaded end 26 of the each dumbbells 12, (i.e., the end opposite to the end which is attached to the weight bar) interchangeably and removably receives the weight plates 18. As described above, an internally-threaded collar 20 is threadably attached to the externally-threaded end 14 of the each dumbbell 12 to secure the weight plates 18 to the dumbbells 12, and hence to the weight bar 10. The weight bar 10 with the dumbbells 12 attached thereto can be used to perform exercises that require an elongated bar for grasping with two hands. As such, in one embodiment, the weight bar 10 has a length that is at least longer than a shoulder width of a typical user.

Figure 8:
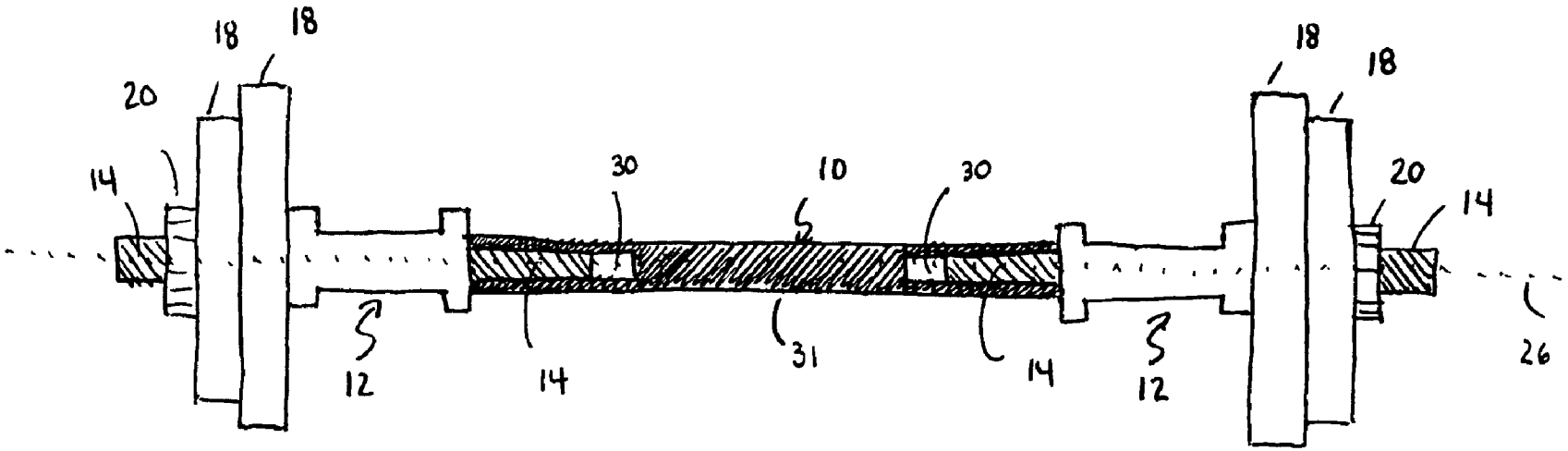
FIG. 8 is another side view of the weight bar and dumbbells or FIG. 5 showing weight plates attached to each dumbbell and showing the threading engagement of the dumbbells to the weight bar in cross-section.

FIG. 8 is a cross-sectional view of FIG. 7, which illustrates a dumbbell 12 attached to each axial end 28 of the weight bar 10. As shown, the externally-threaded ends 14 of the dumbbells 12 are threadably attached to the internally-threaded ends 30 of the weight bar 10.

Figure 9:
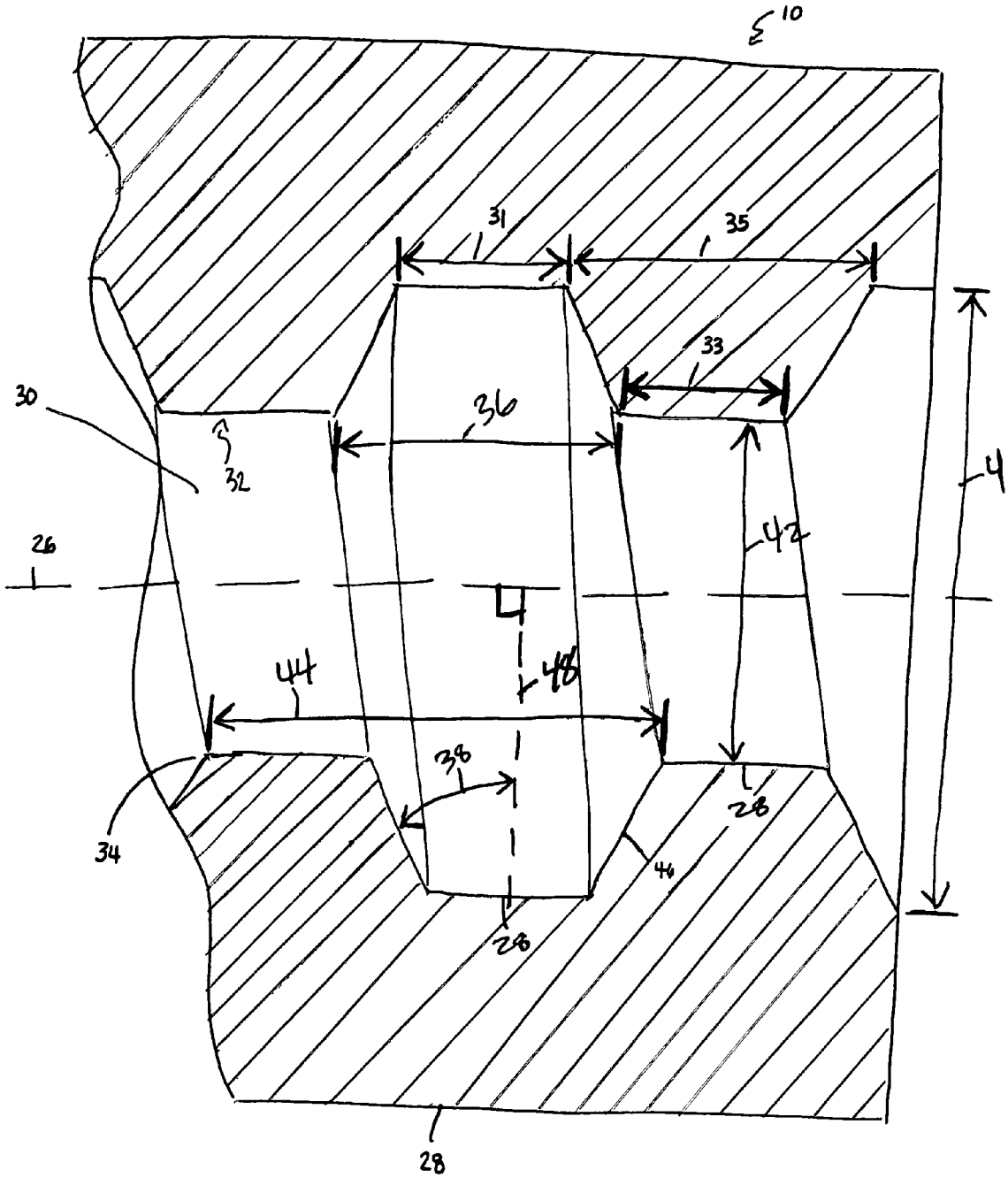
FIG. 9 is an enlarged cross-sectional view of an internally-threaded end of the weight bar of FIG. 4.

FIG. 9 is an enlarged, cross-sectional view of the internally-threaded section 30 of the axial ends 28 of the weight bar 10. As shown, the flat thread ends 34 have thread profiles parallel to the longitudinal axis 26 of the weight bar 10. The flat thread ends 34 include a root flat 31 and a crest flat 33. The profile of the root flat 31 and the crest flat 33, when viewed in cross-section, extend parallel to the longitudinal axis 26 of the weight bar 10. Extending between adjacent root flats 31 is a base 35. Extending between adjacent crest flats 33 is a crest valley 36. The base 35 is longer in dimension than the crest flat 33. The crest valley 36 is longer in dimension than the root flat 31. The root flat 31 is connected to the crest flat 33 by a side 46. A flank angle 38 is defined as the angle between the side 46 and a line 48 that is perpendicular to the longitudinal axis 26. The root flat 31 is formed at the major diameter 40 of the thread 32. The crest flat 33 is formed at the minor diameter 42 of the thread 32. A pitch 44 of the thread 32 is a dimension measured parallel to the longitudinal axis 26, between corresponding points on adjacent threads in the same axial plane.

In one embodiment of the weight bar 10, the internally-threaded sections 30 are structured to receive varying sizes of external threads. For example, any combination of the root flat 31, the crest valley 36, the major diameter 40, the minor diameter and the flank angle 38 of the weight bar threads 32 may be larger than that which is normally used to mate with a particular thread. This allows the internal threads 32 of the weight bar 10 to receive different sized external threads 14 from various dumbbells 12.

In one embodiment, the pitch 44 of the weight bar threads 32 is approximately 0.20 to 0.375 inches; the root flat 31 is approximately 00.125 to approximately 0.155 inches; the crest valley 36 is approximately 0.160 to approximately 0.185 inches; the major diameter 40 is approximately 0.97 to approximately 1.03 inches; and the minor diameter 42 is approximately 0.89 to approximately 0.95 inches. Any of these dimensions of the thread profile can be used in combination with each other or used alone.

The weight bar 10 can be manufactured from any structural material capable of carrying a structural load. This includes metals, plastics or any other structural material available. The weight bar 10 can be made from a single material, or made from a multitude of materials. The weight bar 10 can be manufactured in a multitude of ways by either machining, casting, molding, welding or any other known manufacturing method. In one embodiment, the weight bar 10 is constructed from a metal material that is plated or otherwise covered, for example by a chrome platting or a rubber covering, among other appropriate plantings or coverings. The embodiments described herein are not meant to limit the possible material combinations or manufacturing methods.

A straight thread is a thread formed on a cylinder. This means the thread does not widen or narrow along the longitudinal axis 26. A straight thread can also be described as a parallel thread. In one embodiment of the present invention the internally-threaded sections 30 of the weight bar 10 contain straight threads.

A right-handed thread is a thread which, when assembled with a fixed mating thread and turned in a clockwise direction, moves away from the operator. In one embodiment of the present invention the internally-threaded sections 30 of the weight bar 10 contain right-handed threads.

A symmetrical thread is one having equal flank angles 38. In one embodiment of the present invention the internally-threaded sections 30 of the weight bar 10 contain symmetrical threads. A flank angle of a symmetrical thread is commonly termed the half angle of the thread.

Although a specific dumbbell has been described above other dumbbells may be used in conjunction with the weight bar of the present invention as long as the dumbbell has external threads that engage the internal threads of the weight bar.

The preceding description has been presented with reference to presently preferred embodiments of the invention. Persons skilled in the art and technology to which this invention pertains will appreciate that alterations and changes in the described structure and methods of operation can be practiced without meaningfully departing from the principle, spirit and scope of the invention. Accordingly, the foregoing description should not be read as pertaining only to the precise structures described and shown in the accompanying drawings, but rather should be read as consistent with and as support for the following claims, which are to have their fullest and fairest scope.

What is claimed is:

1. A weight bar and two dumbbells, comprising:

a weight bar including a substantially cylindrical elongated bar comprising a longitudinal axis, first and second axial ends, and an intermediate section extending between the axial ends; and two dumbbells each including a substantially cylindrical bar with first and second externally threaded end sections, the first end section of each dumbbell being threaded into the weight bar, and the second end section of each dumbbell carrying multiple weight plates secured thereon by a collar threadably engaging the second end section;

wherein the substantially cylindrical elongated bar of the weight bar is longer than the substantially cylindrical bar of each of the two dumbbells and is dimensioned to be gripped by a user with two hands that are approximately shoulder width apart;

wherein the first and second axial ends each comprise an internally-threaded section disposed substantially along the longitudinal axis and threadably receiving the externally-threaded end of a dumbbell, wherein the internally-threaded sections of the first and second axial ends each comprise box-shaped threads structured to receive varying sizes of external threads, and wherein the box-shaped threads comprise substantially flat thread ends.

2. The weight bar and two dumbbells of claim 1, wherein said substantially flat thread ends comprises root flats and crest flats that each extend substantially parallel to the longitudinal axis.

3. The weight bar and two dumbbells of claim 1, wherein the threads of the internally-threaded sections of the first and second axial ends are box-shaped threads.

4. The weight bar and two dumbbells of claim 1, wherein the threads of the internally-threaded sections are straight symmetrical.

5. The weight bar and two dumbbells of claim 1, wherein the threads of the internally-threaded sections of the first and second axial ends are each structured to receive varying sizes of external threads.

6. The weight bar and two dumbbells of claim 5, wherein the threads of the internally-threaded sections of the first and second axial ends comprise a root flat, a base, a crest flat, a crest valley, a flank angle, a major diameter, a minor diameter and a pitch, wherein the root flat and the crest flat are each substantially flat and substantially parallel to the longitudinal axis.

7. The weight bar and two dumbbells of claim 6, wherein the root flat is within the range of approximately 0.125 to approximately 0.155 inches.

8. The weight bar and two dumbbells of claim 6, wherein the crest valley is within the range of approximately 0.160 to approximately 0.185 inches.

9. The weight bar and two dumbbells of claim 6, wherein the major diameter is within the range of approximately 0.97 to approximately 1.03 inches.

10. The weight bar and two dumbbells of claim 6, wherein the minor diameter is within the range of approximately 0.89 to approximately 0.95 inches.

11. The weight bar and two dumbbells of claim 6, wherein the pitch is within the range of approximately 0.20 inches to approximately 0.375 inches.

12. The weight bar and two dumbbells of claim 6, wherein the root flat is within the range of approximately 0.125 to approximately 0.155 inches, the crest valley is within the range of approximately 0.160 to approximately 0.185 inches, the major diameter is within the range of approximately 0.97 to approximately 1.03 inches, the minor diameter is within the range of approximately 0.89 to approximately 0.95 inches, and the pitch is within the range of approximately 0.20 inches to approximately 0.375 inches.

13. A weight bar and two dumbbells, comprising:

a weight bar including a substantially cylindrical elongated bar comprising a longitudinal axis, first and second axial ends, and an intermediate section extending between the axial ends; and two dumbbells each including a substantially cylindrical bar with first and second externally threaded end sections, the first end section of each dumbbell being threaded into the weight bar, and the second end section of each dumbbell carrying multiple weight plates secured thereon by a collar threadably engaging the second end section;

wherein the substantially cylindrical elongated bar of the weight bar is longer than the substantially cylindrical bar of each dumbbell;

wherein the first and second axial ends each comprise an internally-threaded section disposed substantially along the longitudinal axis and threadably receiving the externally-threaded end of a dumbbell, wherein the internally-threaded sections of the first and second axial ends each comprise box-shaped threads structured to receive varying sizes of external threads, and wherein the box-shaped threads comprise substantially flat thread ends.

14. The weight bar and two dumbbells of claim 13, wherein said substantially flat thread ends comprise root flats and crest flats that each extend substantially parallel to the longitudinal axis.

15. The weight bar and two dumbbells of claim 13, wherein the threads of the internally-threaded sections are straight and symmetrical.

16. The weight bar and two dumbbells of claim 13, wherein the threads of the internally-threaded sections of the first and second axial ends comprise a root flat, a base; a crest flat, a crest valley, a flank angle, a major diameter, a minor diameter and a pitch, wherein the root flat and the crest flat are each substantially flat and substantially parallel to the longitudinal axis.

17. The weight bar and two dumbbells of claim 15, wherein the root flat is within the range of approximately 0.125 to approximately 0.155 inches.

18. The weight bar and two dumbbells of claim 15, wherein the crest valley is within the range of approximately 0.160 to approximately 0.185 inches.

19. The weight bar and two dumbbells of claim 15, wherein the major diameter is within the range of approximately 0.97 to approximately 1.03 inches.

20. The weight bar and two dumbbells of claim 15, wherein the minor diameter is within the range of approximately 0.89 to approximately 0.95 inches.

21. The weight bar and two dumbbells of claim 15, wherein the pitch is within the range of approximately 0.20 inches to approximately 0.375 inches.

22. The weight bar and two dumbbells of claim 15, wherein the root flat is within the range of approximately 0.125 to approximately 0.155 inches, the crest valley is within the range of approximately 0.160 to approximately 0.185 inches, the major diameter is within the range of approximately 0.97 to approximately 1.03 inches, the minor diameter is within the range of approximately 0.89 to approximately 0.95 inches, and the pitch is within the range of approximately 0.20 inches to approximately 0.375 inches.

23. A weight bar and two dumbbells, comprising:

an integral a weight bar including a substantially cylindrical elongated bar comprising a longitudinal axis, first and second axial ends, and an intermediate section extending between the axial ends; and two dumbbells each including a substantially cylindrical bar with first and second externally threaded end sections, the first end section of each dumbbell being threaded into the weight bar, and the second end section of each dumbbell carrying multiple weight plates secured thereon by a collar threadably engaging the second end section;

wherein the substantially cylindrical elongated bar of the weight bar is longer than the substantially cylindrical bar of each dumbbell;

wherein the first and second axial ends each comprise an internally-threaded section disposed substantially along the longitudinal axis and threadably receiving the externally-threaded end of a dumbbell, wherein the internally-threaded sections of the first and second axial ends each comprise box-shaped threads structured to receive varying sizes of external threads, and wherein the box-shaped treads comprise substantially flat thread ends.

24. The weight bar and two dumbbells of claim 23, wherein the threads of the internally-threaded sections of the first and second axial ends comprise a root flat, a base, a crest flat, a crest valley, a flank angle, a major diameter, a minor diameter and a pitch, wherein the root flat and the crest flat are each substantially flat and substantially parallel to the longitudinal axis.

25. The weight bar and two dumbbells of claim 24, wherein the root flat is within the range of approximately 0.125 to approximately 0.155 inches, the crest valley is within the range of approximately 0.160 to approximately 0.185 inches, the major diameter is within the range of approximately 0.97 to approximately 1.03 inches, the minor diameter is within the range of approximately 0.89 to approximately 0.95 inches, and the pitch is within the range of approximately 0.20 inches to approximately 0.375 inches.

26. The weight bar and two dumbbells of claim 1, wherein the first and second dumbbells each comprises a stop adjacent to the second externally threaded end section to removably secure the weight plates between the collar and the stop.

* * * * *

UNITED STATES PATENT AND TRADEMARK OFFICE

CERTIFICATE OF CORRECTION

PATENT NO. : 7,364,536 B2
APPLICATION NO. : 10/987050
DATED : April 29, 2008
INVENTOR(S) : Cesar A. Cappellini It is certified that error appears in the above-identified patent and that said Letters Patent is hereby corrected as shown below:

| | |
|---|---|
| Column 6, line 41, Claim 2 | Delete “comprises”,<br>Insert --comprise-- |
| Column 8, line 17, Claim 23 | After “integral”,<br>Delete “a” |
| Column 8, line 38, Claim 23 | Delete “treads”,<br>Insert --threads-- |

Signed and Sealed this

Sixth Day of January, 2009

JON W. DUDAS
*Director of the United States Patent and Trademark Office*